US008170259B2

(12) United States Patent
Liu

(10) Patent No.: US 8,170,259 B2
(45) Date of Patent: May 1, 2012

(54) ELECTRONIC DEVICE DISPOSING STRUCTURE

(76) Inventor: Keng-Yuan Liu, Taipei County (TW)

( * ) Notice: Subject to any disclaimer, the term of this patent is extended or adjusted under 35 U.S.C. 154(b) by 359 days.

(21) Appl. No.: 12/684,455

(22) Filed: Jan. 8, 2010

(65) Prior Publication Data

US 2011/0170725 A1 Jul. 14, 2011

(51) Int. Cl.
*H04R 25/00* (2006.01)

(52) U.S. Cl. ..... 381/365; 381/366; 381/388

(58) Field of Classification Search ..... 455/90, 455/556–557, 575; 381/306, 311, 87, 333–336, 381/337–341, 150, 361, 363, 365–366, 388
See application file for complete search history.

(56) References Cited

U.S. PATENT DOCUMENTS 7,095,867 B2 * 8/2006 Schul et al. ..... 381/334
7,678,985 B2 * 3/2010 Adams et al. ..... 381/118

* cited by examiner

*Primary Examiner* — Suhan Ni
(74) *Attorney, Agent, or Firm* — WPAT, P.C.; Anthony King

(57) ABSTRACT

An electronic device disposing structure includes a stand having a position limiting area, a sound receiving channel on the stand and including a sound inlet hole at a distal surface of the stand, a sound outlet hole at a bottom surface of the position limiting area, and a passage portion for interconnecting the sound inlet and outlet holes, and a sound emitting channel on the stand and including a sound outlet hole at the distal surface of the stand, a sound inlet hole at the bottom surface of the position limiting area, and a passage portion for interconnecting the sound outlet and inlet holes. The electronic device disposing structure combines a portable electronic device into the position limiting area, such that a microphone and a speaker respond to sound receiving and emitting channels respectively to achieve a hand-free effect and a sound amplification without requiring a circuit design.

6 Claims, 5 Drawing Sheets

ELECTRONIC DEVICE DISPOSING STRUCTURE

FIELD OF THE INVENTION

The present invention relates to an electronic device disposing structure, in particular to an electronic device disposing structure capable of achieving a hand-free effect and a sound amplification without requiring a circuit design.

BACKGROUND OF THE INVENTION

In general, traditional hand-free portable electric device disposing stands are divided into at least two types: a simple disposing stand provided for the only purpose of disposing and fixing a portable electronic device, such that users need not to pick up an external input/output device such as a speaker or an earphone in order to use the electronic device, and another disposing stand having an input/output device such as a connecting base, a power cord, a speaker and an earphone installed on the disposing stand, such that the portable electronic device can be combined with the disposing stand directly without the need of connecting different peripherals to achieve a hand-free effect and a sound amplification when the electronic device is used.

However, the aforementioned simple disposing stand requires various different peripherals and causes tremendous troubles for using the electronic device. Furthermore, the disposing stand combined with the connecting wires and the input/output functions not only comes with a complicated structure, but also requires the installation of related circuits that incurs a higher cost and results in a damage easily.

Therefore, it is a main subject for the present invention to disclose an electronic device disposing structure capable of achieving a hand-free effect and a sound amplification without requiring a circuit design.

SUMMARY OF THE INVENTION

In view of the aforementioned shortcomings of the prior art, the inventor of the present invention based on years of experience in the related industry to conduct extensive researches and experiments, and finally developed an electronic device disposing structure to achieve a hand-free effect and a sound amplification without requiring a circuit design, so as to overcome the shortcomings of the prior art.

Therefore, it is a primary objective of the present invention to provide an electronic device disposing structure for combining a portable electronic device into a position limiting area of a stand, such that a sound receiving microphone and a sound emitting speaker of the portable electronic device correspond to a sound receiving channel and a sound emitting channel respectively to achieve a hand-free effect and a sound amplification without requiring a circuit design.

To achieve the foregoing objectives, the present invention provides an electronic device disposing structure comprising: a stand having a position limiting area; a sound receiving channel disposed on the stand and including a sound inlet hole formed at an distal surface of the stand, a sound outlet hole formed at a side of the bottom surface of the position limiting area and a passage portion for interconnecting the sound inlet and outlet holes; and a sound receiving channel disposed on the stand and including a sound outlet hole formed on an distal surface of the stand, a sound inlet hole formed at another side of the bottom surface of the position limiting area and a passage portion for interconnecting the sound inlet and outlet holes.

Therefore, the present invention provides an electronic device disposing structure capable of combining the portable electronic device into the position limiting area of the stand, such that a sound receiving microphone and a sound emitting speaker correspond to a sound receiving channel and a sound emitting channel respectively, so as to achieve a hand-free effect and a sound amplification without requiring a circuit design.

DESCRIPTION OF THE PREFERRED EMBODIMENTS

To make it easier for the examiner to understand the objects, characteristics and effects of this invention, we use preferred embodiments together with the attached drawings for the detailed description of the invention as follows.

Figure 1:
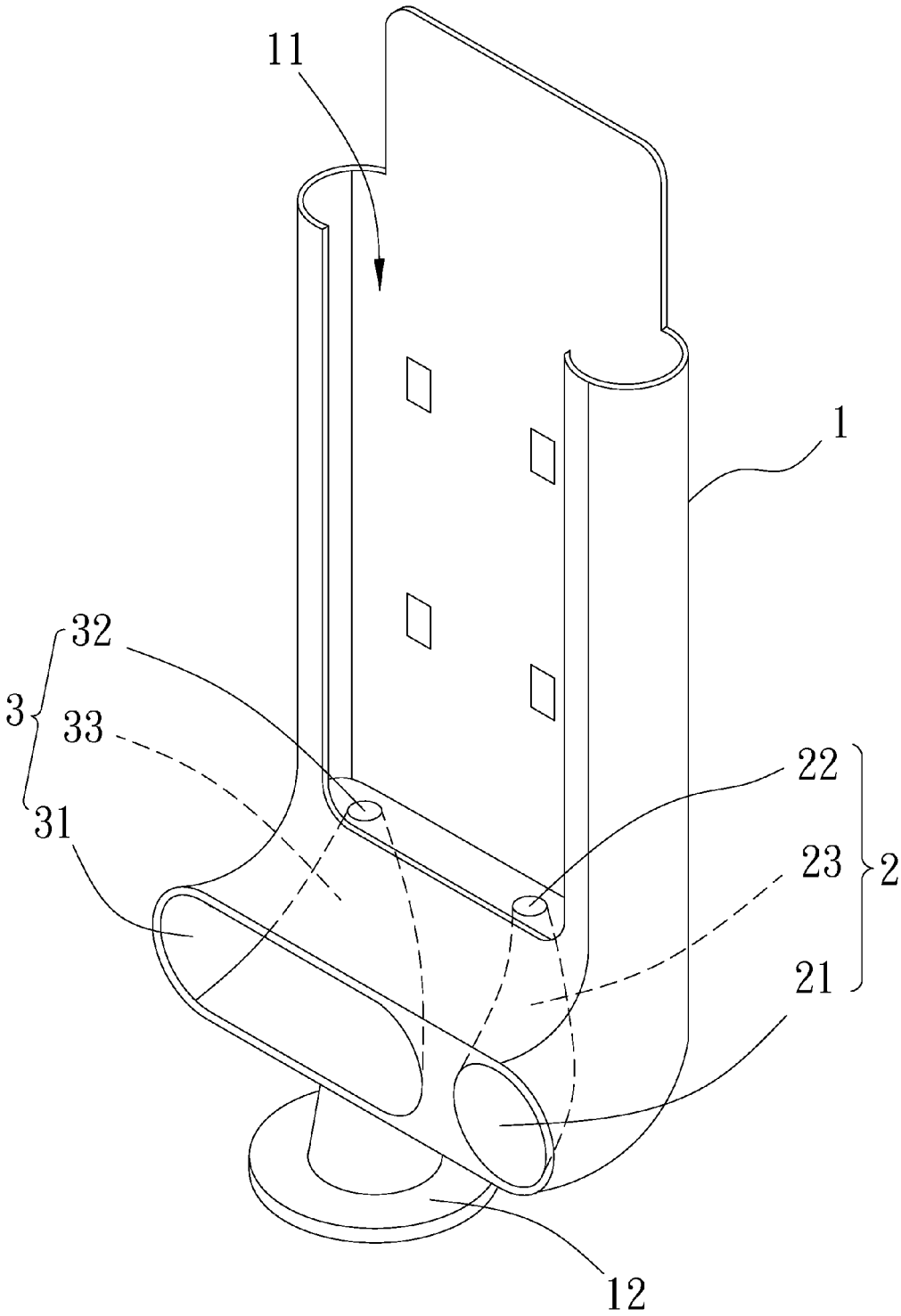
FIG. 1 is a perspective view of a first preferred embodiment of the present invention.

With reference to FIG. 1 for a perspective view of an electronic device disposing structure in accordance with a first preferred embodiment of the present invention, the electronic device disposing structure comprises a stand 1, a sound receiving channel 2 and a sound emitting channel 3.

The stand 1 has a position limiting area 11, and the stand 1 further includes a support unit 12 movably combined with the stand 1.

The sound receiving channel 2 is disposed on the stand 1 and includes a sound inlet hole 21 formed on a side of a distal surface of the stand 1, a sound outlet hole 22 formed at a side of the bottom surface of the position limiting area 11, and a passage portion 23 for interconnecting the sound inlet and outlet holes 21, 22, wherein the sound inlet hole 21 is greater than sound outlet hole 22, and the passage portion 23 is tapered towards the sound outlet hole 22.

The sound emitting channel 3 is disposed on the stand 1 and includes a sound outlet hole 31 formed at another side of the distal surface of the stand 1, a sound inlet hole 32 formed at another side of the bottom surface of the position limiting area 11, and a passage portion 33 for interconnecting the sound outlet and inlet holes 31, 32, wherein the sound outlet hole 31 is greater than the sound inlet hole 32, and the passage portion 33 is tapered towards the sound inlet hole 32.

Figure 2:
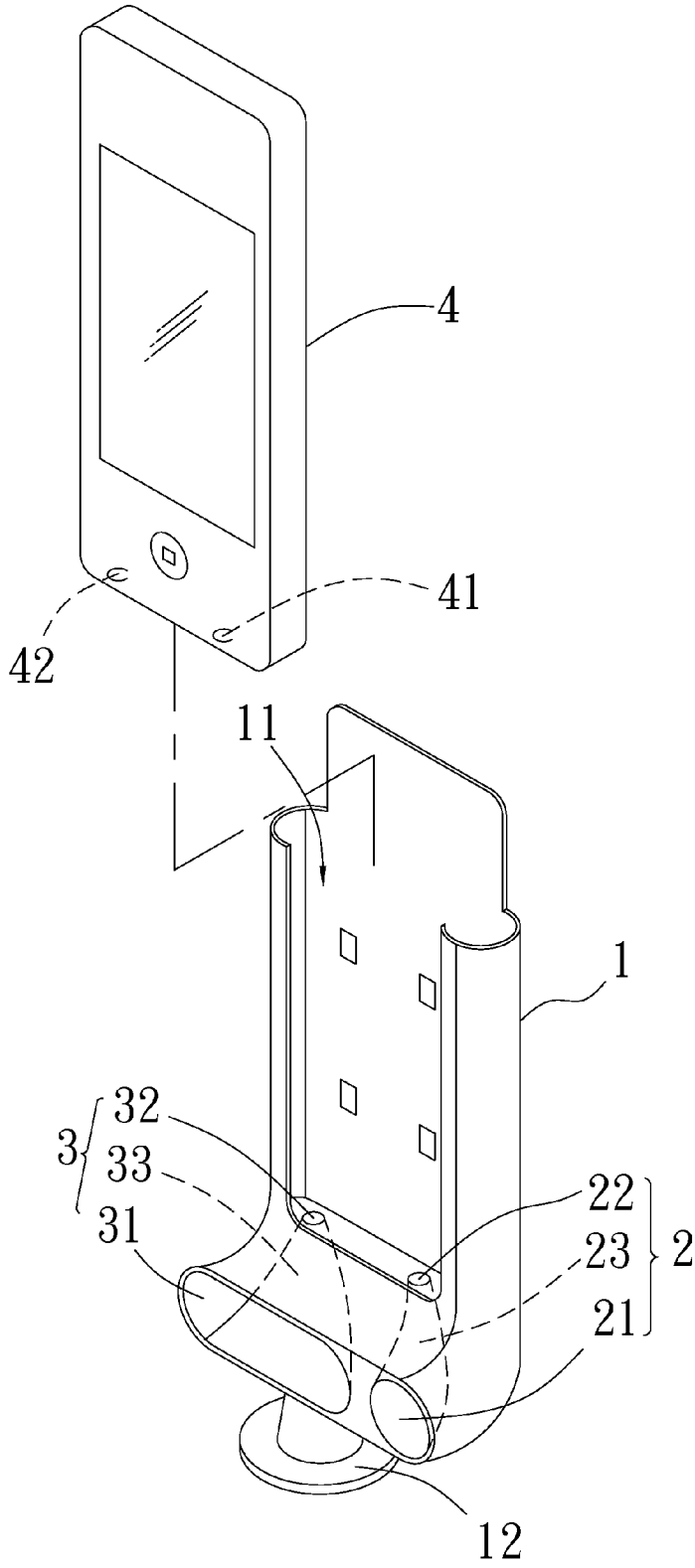
FIG. 2 is a schematic view of an application in accordance with a first preferred embodiment of the present invention.
Figure 3:
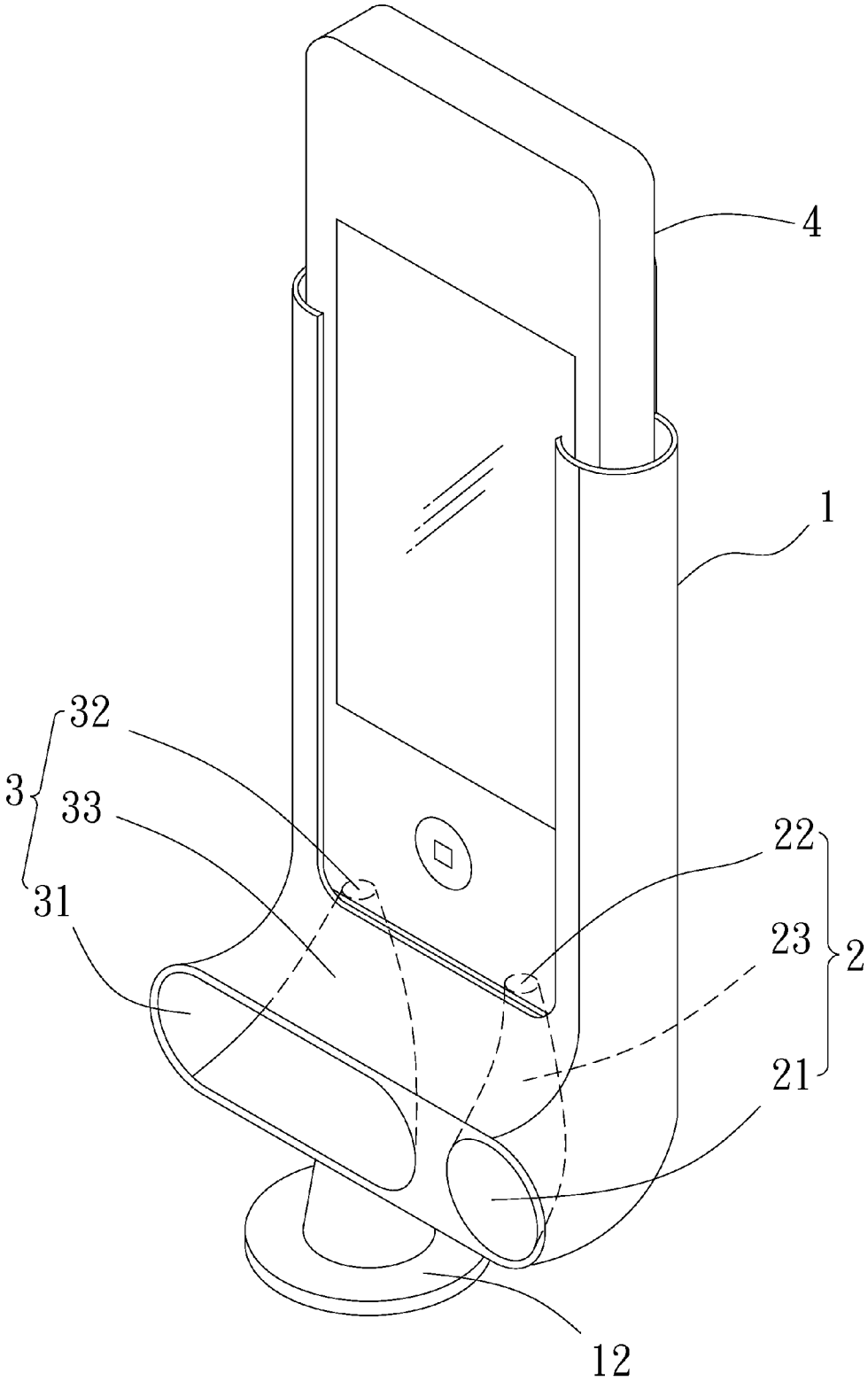
FIG. 3 is a schematic view of a disposing structure combined with a portable electronic device in accordance with a first preferred embodiment of the present invention.

With reference to FIGS. 2 and 3 for schematic views of an application and a disposing structure combined with a portable electronic device in accordance with a first preferred embodiment of the present invention respectively, when the disposing structure of the present invention is applied, the stand 1 is installed at a related position (not shown in the figure) in a car, onto a bicycle or a desktop by using a support unit 12, and a portable electronic device 4 (such as an iphone) is combined into the position limiting area 11, such that a sound receiving microphone 41 and a sound emitting speaker 42 of the portable electronic device 4 correspond to the sound outlet hole 22 of the sound receiving channel 2 and the sound inlet hole 32 of the sound emitting channel 23 respectively, and the stand 1 and the support unit 12 are used to achieve a free-hand effect. If a user is using the portable electronic device 4 to receive a phone call in a free-hand manner, the user's voice enters into the sound inlet hole 21 and passes through the passage portion 23 to the sound outlet hole 22 for its output to the sound receiving microphone 41 for a sound receiving process. The sound receiving channel 2 is provided for collecting the user's voice and transmitting the voice or sound to the sound receiving microphone 41, so that the portable electronic device 4 can transmit the user's voice to a receiving party clearly.

If the user wants to use the portable electronic device 4 to play music, the music enters into the sound inlet hole 32 of the sound emitting channel 3 and passes through the passage portion 33 to the sound outlet hole 31 for an output. The sound emitting channel 3 is provided for amplifying the sound, such that the sound amplification can be achieved without requiring a circuit design.

Figure 4:
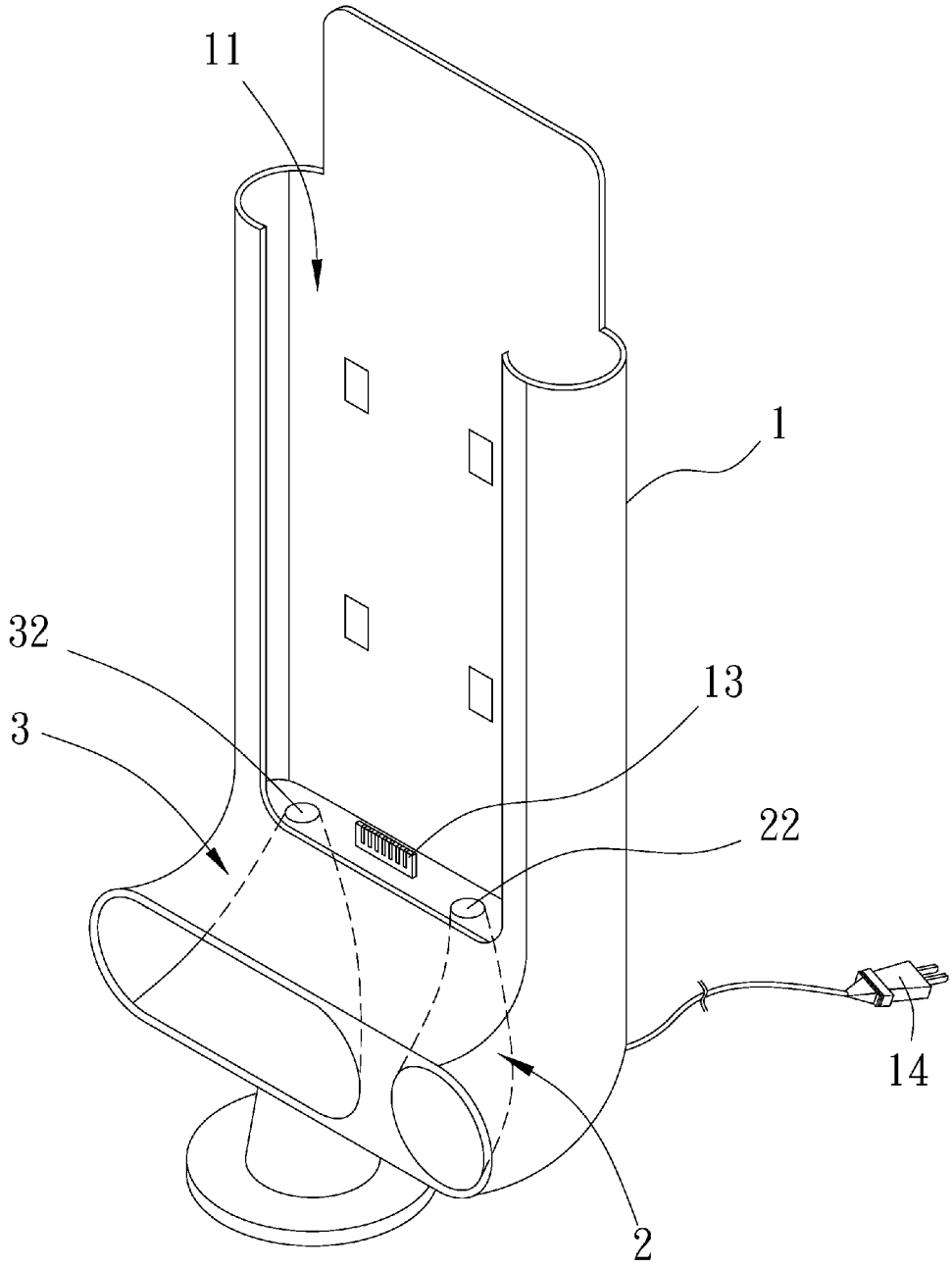
FIG. 4 is a perspective view of a second preferred embodiment of the present invention.

With reference to FIG. 4 for a perspective view of a second preferred embodiment of the present invention, the invention can adopt a structure in accordance with the second preferred embodiment, in addition to the structure as disclosed in the first preferred embodiment, and their difference resides on that the second preferred embodiment comprises an electric connecting base 13 disposed at the middle of a bottom surface of the position limiting area 11 of the stand 1 and coupled to a power connector 14, such that when the portable electronic device (not shown in the figure) is combined into the position limiting area 11, the sound receiving microphone and the sound emitting speaker of the portable electronic device correspond to the sound outlet hole 22 and the sound inlet hole 32 respectively, and a connector at the bottom of the electronic device is aligned and coupled to the electric connecting base 13 precisely, so that the portable electronic device can input and output sounds by the sound receiving channel 2 and sound emitting channel 3 respectively, while charging the portable electronic device by an external electric power through the power connector 14.

Figure 5:
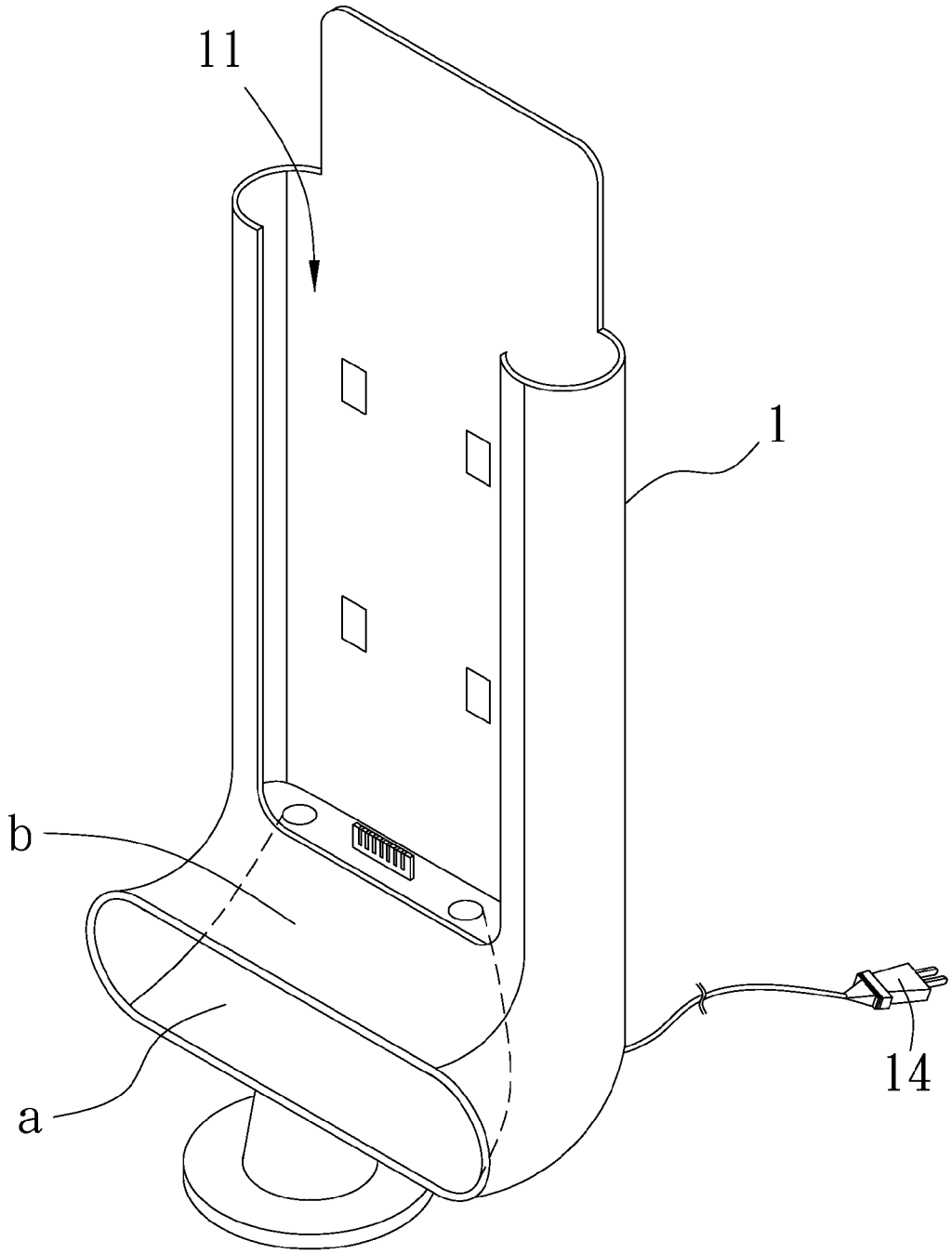
FIG. 5 is a perspective view of a third preferred embodiment of the present invention.

With reference to FIG. 5 for a perspective view of a third preferred embodiment of the present invention, the invention can adopt a structure in accordance with the third preferred embodiment, in addition to the structures as disclosed in the first and second preferred embodiments, and their difference resides on that the third preferred embodiment further comprises an expanded hole interconnected with the sound inlet hole 21 and the sound outlet hole 31, and the passage portions 23, 33 are interconnected to form a hole passage b, so as to achieve the required sound amplification effect.

In summation of the description above, the present invention combines the portable electronic device into the position limiting area of the stand, such that the sound receiving microphone and the sound emitting speaker of the portable electronic device correspond to the sound receiving and emitting channels respectively to achieve a hand-free effect and a sound amplification without requiring a circuit design. In addition, products of the invention can meet the market requirements, and the present invention complies with patent application requirements, and thus is duly filed for patent application.

While the invention has been described by means of specific embodiments, numerous modifications and variations could be made thereto by those skilled in the art without departing from the scope and spirit of the invention set forth in the claims.

What is claimed is:

1. An electronic device disposing structure, comprising:

a stand, having a position limiting area;

a sound receiving channel, disposed on a stand, and including a sound inlet hole formed at a distal surface of the stand, a sound outlet hole formed at a bottom surface of the position limiting area, and a passage portion for interconnecting the sound inlet and outlet holes; and a sound receiving channel, disposed on the stand, and including a sound outlet hole formed at the distal surface of the stand, a sound inlet hole formed at the bottom surface of the position limiting area, and a passage portion for the interconnecting the sound outlet and inlet holes.

2. The electronic device disposing structure of claim 1, wherein the stand further includes a support unit coupled thereon.

3. The electronic device disposing structure of claim 1, wherein the position limiting area includes an electric connecting base disposed at the middle of the bottom surface of the position limiting area, and coupled to a power connector.

4. The electronic device disposing structure of claim 1, wherein the sound inlet hole of the sound receiving channel is greater than the sound outlet hole, and the passage portion is tapered towards the sound outlet hole.

5. The electronic device disposing structure of claim 1, wherein the sound outlet hole of the sound receiving channel is greater than the sound inlet hole, and the passage portion is tapered towards the sound inlet hole.

6. The electronic device disposing structure of claim 1, wherein the passage portions of the sound receiving channel and the sound emitting channel are combines into one.

* * * * *